US005341787A

United States Patent [19]

Zabeck et al.

[11] Patent Number: 5,341,787

[45] Date of Patent: Aug. 30, 1994

[54] ELECTROMAGNETICALLY OPERATED VALVE

[75] Inventors: Sebastian Zabeck, Viernheim; Andreas Sausner, Neu Isenburg, both of Fed. Rep. of Germany

[73] Assignee: Firma Carl Freudenberg, Weinheim, Fed. Rep. of Germany

[21] Appl. No.: 115,384

[22] Filed: Sep. 1, 1993

[30] Foreign Application Priority Data

Sep. 1, 1992 [DE] Fed. Rep. of Germany ..... 4229105

[51] Int. Cl.[5] ..... F02M 37/04

[52] U.S. Cl. ..... 123/520; 123/458

[58] Field of Search ..... 123/518, 519, 520, 521, 123/516, 458

[56] References Cited

U.S. PATENT DOCUMENTS

| | | | |
|---|---|---|---|
| 4,901,702 | 2/1990 | Beicht | 123/458 |
| 4,944,276 | 7/1990 | House | 123/520 |
| 4,953,514 | 9/1990 | Beicht | 123/458 |
| 5,060,621 | 10/1991 | Cook | 123/520 |
| 5,103,794 | 4/1992 | Shiraishi | 123/520 |
| 5,216,998 | 6/1993 | Hosoda | 123/520 |

FOREIGN PATENT DOCUMENTS 4003036 11/1990 Fed. Rep. of Germany .

*Primary Examiner*—Carl S. Miller

*Attorney, Agent, or Firm*—Kenyon & Kenyon

[57] ABSTRACT

An electromagnetically operated valve for the clocked feeding of volatile fuel constituents out of the free space of a fuel tank into the intake manifold of an internal combustion engine is disclosed. The valve is provided with at least one intake port and at least one outlet port, a main valve seat and an auxiliary valve seat connected parallel to the main valve seat being provided between the intake and the outlet ports. A corresponding main closing element and an auxiliary closing element are provided, the main closing element having a movable mass $m_I$ and the auxiliary closing element having a movable mass $m_{II}$. The closing elements sealingly contact the corresponding valve seats in a sealed (off) position through the force of at least one valve spring at any one time. The main closing element, when actuated, is shiftable to an open position by a resultant force $F_{resI}$ and the auxiliary closing element is likewise shiftable to an open position by a resultant force $F_{resI}$. The ratio $F_{resI}/m_I$ is smaller than ratio $F_{resII}/m_{II}$.

16 Claims, 1 Drawing Sheet

ELECTROMAGNETICALLY OPERATED VALVE

BACKGROUND OF THE INVENTION

The invention relates generally to improvements in an electromagnetically operated valve for the controlled feeding of volatile fuel components situated in the free space of a fuel tank to the intake manifold of an internal combustion engine. The valve has at least one inlet port and at least one outlet port. Situated between the inlet and outlet ports are a main closing element and corresponding main valve seat, and an auxiliary closing element and corresponding auxiliary valve seat. The auxiliary closing element and valve seat are connected parallel to the main valve seat. The main closing element has a movable mass $m_I$; the auxiliary closing element has a movable mass $m_{II}$. The closing elements sealingly contact the corresponding valve seats to establish an "off" state to which they are urged by the applied force provided by at least one valve spring at any one time. The main closing element, when actuated, is shiftable to an open position by the application of a resultant force $F_{resI}$; the auxiliary closing element is shiftable to an open position by the application of a resultant force $F_{resII}$.

This general type of valve is disclosed in the German Patent 40 03 036 (the contents of which are incorporated herein by reference). In that device, the auxiliary closing element is of a smaller size and mass than the main closing element, so that it can be more quickly shifted into the open position. The main closing element can be hydraulically relieved, so that it too can be given a faster opening speed.

Economy of manufacture is not attainable by a smaller mass alone. To optimize the valve with respect to its working properties, manufacturing expenditure, and assembly, numerous parameters have to be taken into consideration. There remains a need for the further development of valves of this general type.

SUMMARY OF THE INVENTION

The present invention is directed towards the further development of an electromagnetically operated valve of the general type discussed above that is simpler and more economical to manufacture, that exhibits good working properties, and which is so constructed as to allow the component parts employed to usefully influence one another and to be optimally adjusted with respect to one another.

The valve utilizes a main closing element and an auxiliary closing element, each of which is urged against a corresponding valve seat by a spring. The main closing element has a mass that is greater than the mass of the auxiliary closing element. The closing elements are opened against the spring force by a solenoid. The ratio of the vector sum of the forces acting on the main closing element to the mass of the main closing element is less than than the corresponding ratio for the auxiliary closing element. This enables the auxiliary closing element to be operable with less effort and more rapidly, thus accommodating smaller intervals of time, than the main closing element.

The valve is optimized when the ratio of the resultant force on the mass of the main closing element, $F_{resI}/m_I$, is smaller than the corresponding ratio $F_{resII}/m_{II}$ of the auxiliary closing element. To meet these requirements, the rate of build-up of force in the magnetic circuit of the auxiliary valve is faster than or comparable to that of the main valve. Similarly, the valve spring of the auxiliary valve may be initially tensioned to a lesser degree, with respect to the rate of force build-up, than the valve spring of the main valve. Furthermore, given the same pressure ratio, the valve cross-section and, consequently, the throughput, of the main valve can be greater than the valve cross-section and, thus, the throughput of the auxiliary valve. The auxiliary valve has a smaller, (or, in a limiting case, the same-sized) opening cross-section as that of the main valve, but in any event opens before the main valve. To reinforce this tendency of the auxiliary closing element to open before the main closing element, one can select a smaller armature mass, a smaller armature stroke, and a dynamically designed magnetic circuit with less inductance and less magnetic resistance to open the valve. Compared to the auxiliary valve, the opening cross-section of the main valve is the same size or larger. Because of a lower rate of force build-up and/or a higher initial spring tensioning, it is configured to open later than the auxiliary valve. This can be reinforced by a dynamically designed magnetic circuit, a larger opening cross-section, a larger armature mass, and a larger armature stroke.

Economy of manufacture and proper operation are not achieved by increasing the armature mass alone. However, by adjusting the armature mass in conjunction with alterations in the level of the spring preload, designing the magnetic circuit as noted and configuring the opening cross-section areas so that the area of the main seat is greater or equal to the area of the auxiliary seat, there obtains a cost-effective and efficacious solution.

The resultant forces $F_{resI}$, $F_{resII}$, which act on the closing elements are made up of the magnetic force $F_{MI}$, $F_{MII}$, the spring energy $F_{FI}$, $F_{FII}$, and the force due to the weight $F_{GI}$, $F_{GII}$ of the corresponding closing element, which are vectorially added in accordance with their magnitude and direction. According to one advantageous refinement, a simple and economical valve can have an auxiliary closing element having a smaller inertial mass than the main closing element, and/or the auxiliary valve seat can have a smaller opening cross-section than the main valve seat. Such a design obviates the need for certain further variations in the actuating mechanism of the valve.

The main closing element and the auxiliary closing element can be actuated by parallel-connected solenoid coils. A considerable cost reduction can be achieved through the use of modular construction, which employs similar or equivalent component parts.

In an alternate embodiment, the electrically isolated triggering of the main closing element and the auxiliary closing element is likewise possible.

BRIEF DESCRIPTION OF THE DRAWING

The subject matter of the present invention is clarified in greater detail in the following on the basis of the drawing.

DETAILED DESCRIPTION

Figure 1:
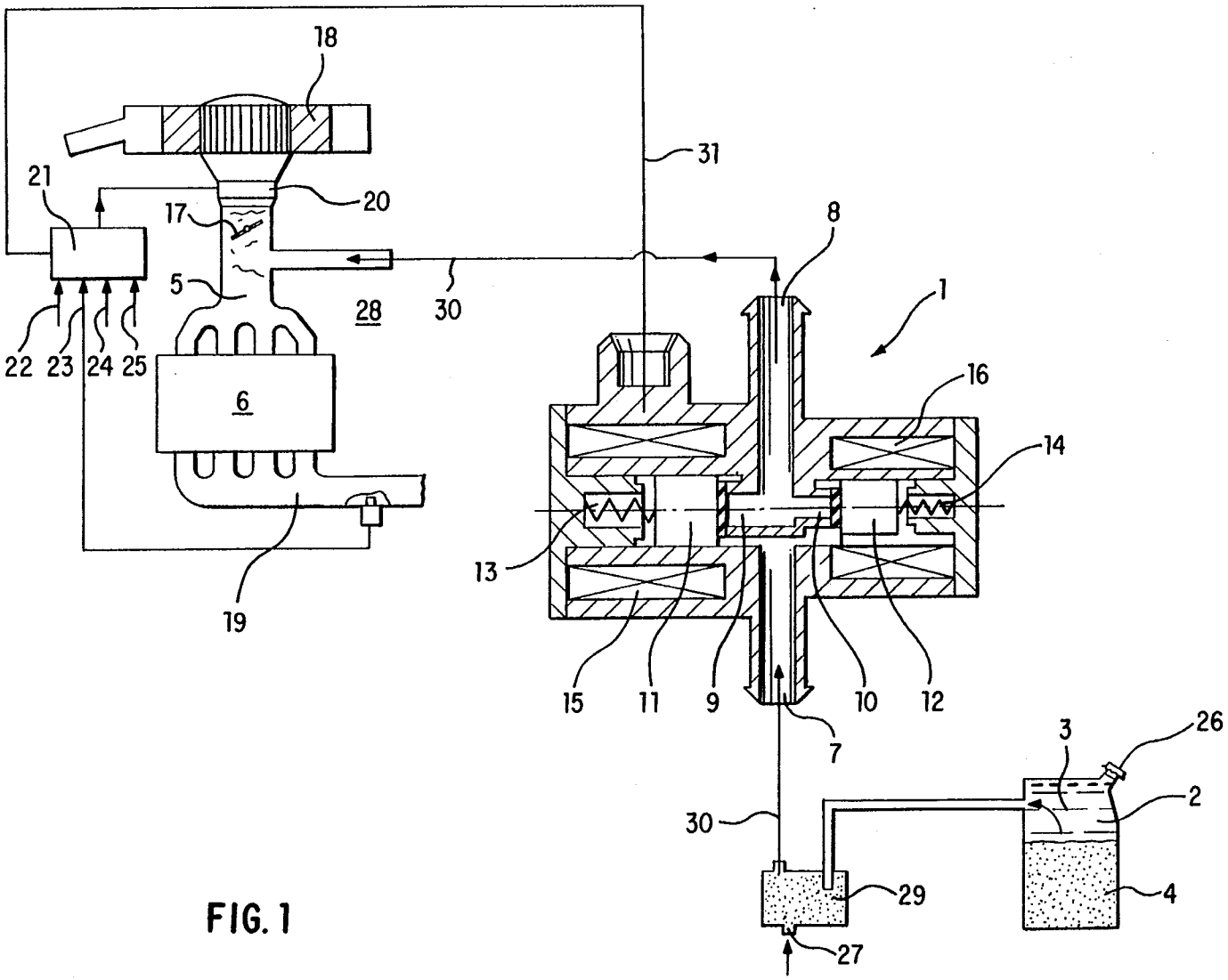
FIG. 1 depicts the components partially in a schematic representation.

An internal combustion machine 6 is coupled to an air filter 18 through an intake manifold 5 containing a throttle valve 17. The exhaust manifold 19 is flange-mounted on the internal combustion machine 6.

A fuel-supplying device 20 is provided in the intake manifold 5, above the throttle valve 17. In this fuel-supplying device 20 (such as a fuel injector), fuel is added, to the extent required, to the volume of fresh air supplied through the air filter 18. The signals required for this are provided a control unit 21, in dependence upon such variables as the temperature and composition of the exhaust gas, the operating speed of the internal combustion engine 6, and the ambient temperature. The corresponding input signals are detected by the appropriate sensors as indicated in the drawing at 22, 23, 24, and 25. If necessary, they can be supplemented by data provided by other sensors as desired.

The fuel tank 4 is only partially filled with liquid fuel and, above the fuel level, it has a free space 3, which is filled with volatile fuel components 2. The fuel tank 4 is hermetically sealed off from the environment by its seal 26, typically a cap. The free space 3 of the fuel tank 4 is connected to the atmosphere 28 through a venting line 27. The venting line 27 is connected with a storage chamber 29, which is filled with a granular material of activated carbon. The dimensioning of the storage chamber 29 is such that volatile fuel constituents cannot pass through the orifice of the venting line 27 under normal operating conditions.

The line 30, which connects the storage chamber 29 to the intake manifold 5 of the internal combustion engine 6, joins up with the side of the storage chamber 29 facing opposite the orifice of the venting line 27. The electromagnetically operated valve 1 is arranged in the line 30. This valve 1 is closed when the internal combustion engine 6 is shut down. It is actuable by the control unit 21, which is linked through an electrical connecting line 31 to the solenoid coils 15, 16 of a main closing element 11 and an auxiliary closing element 12. The main closing element 11 is selectively actuable. When the valve 1 is not actuated, it engages with main valve seat 9 in the off-state via the spring-load provided by the valve spring 13. In the on (solenoid actuated) state, the main closing element is displaced against the spring so as to create a path from the inlet port to the outlet port.

The auxiliary closing element 12 and its associated auxiliary valve seat 10 and corresponding valve spring 14 operate in a similar fashion. The valve springs 13, 14 are designed in each case so that a sealing contact pressure of the valve closing elements 11, 12 on the corresponding valve seats 9, 10 is maintained with only a minimum of contact force. By providing (through the means discussed above) that the ratio of the resultant force acting on the auxiliary closing 12 to the mass of the auxiliary closing element be greater than the ratio of the resultant force acting on the main closing element 11 with respect to the mass of the main closing element, the auxiliary closing element 12 will tend to open first when the two solenoid coils 15 and 16 are activated simultaneously.

The rate of volumetric flow pushed through for each unit of time can be changed, as needed, by providing for the clocked activation of the solenoid coils 15 and 16, by modifying the period of time in which the main and auxiliary closing elements 11 and 12 are opened per activation. The period of time of the activation likewise influences the operational performance of the valve 1. For example, at very high frequencies of activation, the signal effecting the electric activation of the auxiliary closing element 12 can decay before the main closing element 11 can respond to it, so that only the auxiliary closing element 12 opens and closes in response to it in a cyclical action whose period is very brief. The volume of permeated fuel vapors permitted to traverse the valve in this time interval can accordingly be quite small, so that the volatile fuel constituents 2 can be metered at a very fine level from the storage chamber 29 into the internal combustion engine 6. This can be done even at low speeds, for example even during idling, without excessively enriching the fuel-air mixture and causing the breakdown of the internal combustion engine 6.

In some situations, the main closing element 11 and the auxiliary closing element 12 are maintained in the open position for lengthier periods of time. In this situation, the volumetric flow rate of volatile fuel constituents 2 that pass through for each unit of time is especially large. This is the case when the internal combustion engine 6 is driven in partial-load operation or in full-load operation.

The flow rate traversed through the valve 1 according to the invention can be infinitely varied, without requiring the expense of more specialized control circuitry for this purpose. As a result, besides especially good operational performance in the different operating states of the internal combustion engine 6, the valve helps maintain reduced levels of emissions. The valve 1 according to the invention demonstrates excellent working properties and is economical to produce.

We claim:

1. An electromagnetically operated valve for the clocked feeding of volatile fuel components out of the free space of a fuel tank into the intake manifold of an internal combustion engine, comprising:

at least one inlet port and at least one outlet port;

a main valve seat, and a corresponding main closing element having a movable mass $m_I$;

an auxiliary valve seat, and a corresponding auxiliary closing element having a movable mass $m_{II}$ connected parallel to the main valve seat, said valve seats being located between the inlet and the outlet ports;

electromagnetic coils for actuating each of the valves; and at least one valve spring for urging each of the closing elements into sealing contact with the corresponding valve seats in an off position through the force of the at least one valve spring at a given time;

whereby the main closing element, when actuated, is shiftable to an open position by a resultant force $F_{resI}$ and the auxiliary closing element is shiftable to an open position by a resultant force $F_{resII}$, such that the ratio $F_{resI}/m_I$ is smaller than the ratio $F_{resII}/m_{II}$, and the rate of build-up of force $Df_{MII}/dt$ of the electromagnetic coil of the auxiliary closing element is greater than that of rate of build-up of force $Df_{MI}/dt$ of the magnetic coil of the main closing element.

2. The valve according to claim 1, wherein the resultant forces $F_{resI}$, $F_{resII}$, which act on the closing elements are made up of the vectoral sum of the magnetic force $F_{MI}$, $F_{MII}$, the spring energy $F_{FI}$, $F_{FII}$, and the force due to weight $F_{GI}$, $F_{GII}$ of the corresponding closing element.

3. The valve according to claim 1, wherein the auxiliary element has a smaller inertial mass than the main closing element.

4. The valve according to claim 1, wherein the auxiliary valve seat has a smaller opening cross-section than the main valve seat.

5. The valve according to claim 1, wherein the main closing element and the auxiliary closing element are actuable by parallel-connected solenoid coils.

6. The valve according to claim 2, wherein the ratio of the spring energy to the rate of build-up of opening force for the auxiliary closing element is smaller than the same ratio with respect to the main closing element.

7. The valve according to claim 2, wherein the auxiliary element has a smaller inertial mass than the main closing element.

8. The valve according to claim 2, wherein the auxiliary valve seat has a smaller opening cross-section than the main valve seat.

9. An electromagnetically operated valve for the clocked feeding of volatile fuel components out of the free space of a fuel tank into the intake manifold of an internal combustion engine, comprising:

at least one inlet port and at least one outlet port;

a main valve seat, and a corresponding main closing element having a movable mass $m_I$;

an auxiliary valve seat, and a corresponding auxiliary closing element having a movable mass $m_{II}$ connected parallel to the main valve seat, said valve seats being located between the inlet and the outlet ports; and at least one valve spring for urging each of the closing elements into sealing contact with the corresponding valve seats in an off position through the force of the at least one valve spring at a given time;

whereby the main closing element, when actuated, is shiftable to an open position by a resultant force $F_{resI}$ and the auxiliary closing element is shiftable to an open position by a resultant force $F_{resII}$, such that the ratio $F_{resI}/m_I$ is smaller than the ratio $F_{resII}/m_{II}$, and the ratio of the spring energy to the rate of build-up of opening force for the auxiliary closing element is smaller than the same ratio with respect to the main closing element.

10. The valve according to claim 9, wherein the resultant forces $F_{resI}$, $F_{resII}$, which act on the closing elements are made up of the vectoral sum of the magnetic forces provided by actuating electromagnets $F_{MI}$, $F_{MII}$, the spring energy $F_{FI}$, $F_{FII}$, and the force due to weight $F_{GI}$, $F_{GII}$ of the corresponding closing element.

11. The valve according to claim 9, wherein the auxiliary element has a smaller inertial mass than the main closing element.

12. The valve according to claim 9, wherein the auxiliary valve seat has a smaller opening cross-section than the main valve seat.

13. The valve according to claim 9, wherein the main closing element and the auxiliary closing element are actuable by parallel-connected solenoid coils.

14. The valve according to claim 10, wherein the auxiliary element has a smaller inertial mass than the main closing element.

15. The valve according to claim 10, wherein the auxiliary valve seat has a smaller opening cross-section than the main valve seat.

16. An electromagnetically operated valve for the clocked feeding of volatile fuel components out of the free space of a fuel tank into the intake manifold of an internal combustion engine, comprising:

at least one inlet port and at least one outlet port;

a main valve seat, and a corresponding main closing element having a movable mass $m_I$;

an auxiliary valve seat, and a corresponding auxiliary closing element having a movable mass $m_{II}$ connected parallel to the main valve seat, said valve seats being located between the inlet and the outlet ports; and at least one valve spring for urging each of the closing elements into sealing contact with the corresponding valve seats in an off position through the force of the at least one valve spring at a given time;

whereby the main closing element, when actuated, is shiftable to an open position by application of an opening force $F_{openingI}$ and the auxiliary closing element is shiftable to an open position by application of an opening force $F_{openingII}$, such that the ratio $F_{openingI}/m_I$ is smaller than the ratio $F_{opening\,II}/m_{II}$.

* * * * *

UNITED STATES PATENT AND TRADEMARK OFFICE

CERTIFICATE OF CORRECTION

PATENT NO. : 5,341,787
DATED : August 30, 1994
INVENTOR(S) : Zabeck et al.

It is certified that error appears in the above-indentified patent and that said Letters Patent is hereby corrected as shown below:

Title Page:

In the Abstract, second line from the bottom, change "$F_{resI.}$" to -- $F_{resII.}$ --.

Signed and Sealed this

Twenty-eight Day of March, 1995

Bruce Lehman

*Attest:*

BRUCE LEHMAN

*Attesting Officer*

*Commissioner of Patents and Trademarks*